United States Patent [19]

Papsco et al.

[11] 4,040,588

[45] Aug. 9, 1977

[54] BRACKET BASE

[75] Inventors: William G. Papsco; Harry Cohn, Jr., both of Portola Valley; Robert E. Bryan, San Jose, all of Calif.

[73] Assignee: Papsco, Inc., Sunnyvale, Calif.

[21] Appl. No.: 686,117

[22] Filed: May 13, 1976

[51] Int. Cl.[2] ..... A47G 29/02; B65D 25/24

[52] U.S. Cl. ..... 248/245; 108/108; 211/193

[58] Field of Search ..... 248/245, 243, 246; 211/88, 126, 193; 108/107, 108; 312/247, 248; 52/29, 36

[56] References Cited

U.S. PATENT DOCUMENTS

| | | | |
|---|---|---|---|
| 3,564,879 | 2/1971 | Bennett | 70/58 X |
| 3,729,113 | 4/1973 | Lopatka | 312/247 X |
| 3,886,698 | 6/1975 | Raith | 52/36 |

FOREIGN PATENT DOCUMENTS

| | | | |
|---|---|---|---|
| 1,314,012 | 11/1961 | France | 248/245 |
| 1,115,938 | 6/1968 | United Kingdom | 248/245 |

*Primary Examiner*—J. Franklin Foss

[57] ABSTRACT

A universal base for a bracket system comprises an open ended tubular member having a rectangular cross section. A T-shaped tongue projects at an angle from one end of the base back wall and the opposite or front wall is formed with at least two laterally spaced pairs of vertically spaced slots. With the tongue of one base engaged in the opening of a lipped channel member, the slots are simultaneously engageable by two shelf brackets or alternatively the upper open end of the base may accept a cabinet bracket that is laterally positionable over part of the width of the base.

4 Claims, 7 Drawing Figures

BRACKET BASE

BACKGROUND OF THE INVENTION

This invention relates to an improved bracket base for detachably connecting, positioning and locking brackets and the like for adjustable wall-mounted shelves, cabinets, tables, platforms, fixtures, frames and the like.

A general object of the invention is the provision of a bracket base that is capable of supporting a plurality of shelf brackets simultaneously on a vertical channel member.

A further object is the provision of a bracket base that is capable of supporting a cabinet bracket on a fixed channel member while permitting limited lateral adjustment of cabinet position relative to the channel member.

These and other objects of the invention are achieved with an open ended tubular base having a generally rectangular cross section and a plurality of laterally spaced pairs of bracket slots in the forward wall.

DESCRIPTION OF PREFERRED EMBODIMENT

Figure 1:
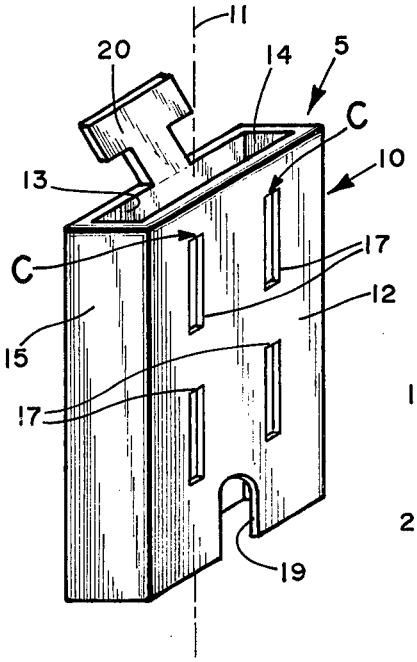
FIG. 1 is a perspective view of a bracket base embodying the invention.

Referring now to the drawings, a bracket base 5 embodying the invention comprises an elongated tubular member 10 of rectangular cross section having a longitudinal axis 11 and comprising a plane front wall 12, a plane rear wall 13 and side walls 14 and 15. Member 10 is preferably is made from relatively heavy gauge metal such as 0.090 inches steel plate to provide the support necessary for heavy shelf loads.

Front wall 12 is formed with a plurality of longitudinally elongated preferably rectangularly shaped slots 17 arranged in laterally spaced columns C and with two longitudinally spaced slots to a column. The slots in each column are engageable by the support fingers of bracket elements, not shown, as is well known in the art. In the preferred embodiment shown in the drawing front wall 12 has two columns of slots symmetrically spaced about the longitudinal center plane of the bracket.

The lower end, as viewed, of the front wall is formed with a recess 19 to permit locking of the bracket in its final support position as explained below.

Figure 2:
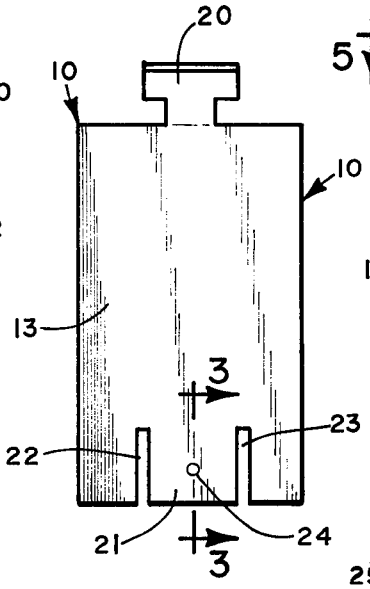
FIG. 2 is a rear view of the bracket base.
Figure 4:
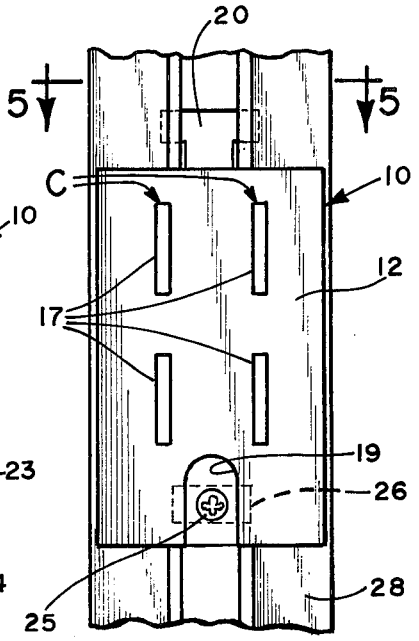
FIG. 4 is a front view of a bracket base mounted on a vertical channel member.
Figure 3:
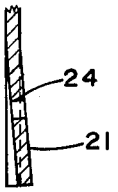
FIG. 3 is a section taken on line 3—3 of FIG. 2.
Figure 5:
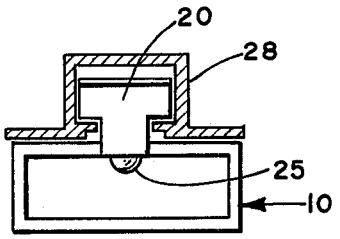
FIG. 5 is a transverse section taken on line 5—5 of FIG. 4.
Figure 6:
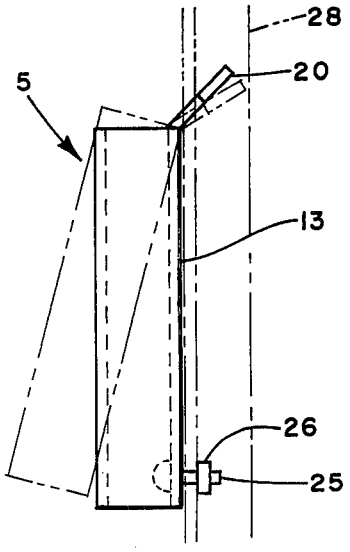
FIG. 6 is a side view of the bracket base, the channel member being shown in broken lines.

Rear wall 13 has a preferably integral T-shaped tongue 20 projecting longitudinally, upwardly as viewed, and inclined rearwardly in a direction away from the front wall. The lower end of rear wall 13 has a central tap 21, see FIG. 2, defined cuts or recesses 22 and 23 and bent slightly outwardly from the plane of the wall as shown in FIG. 3. A tapped hole 24 in tab 21 is adapted to receive a screw 25, see FIGS. 4 and 6, to which a T-nut 26 is connectable.

Base 5 is connectable to an elongated lipped channel member 28 by tongue 20 which is inserted within the member by rotation of the base. Channel member 28 is secured to a supporting wall or may comprise an integral part of the wall or partition structure to which a shelf or the like is to be connected. After tongue 20 is inserted within channel member 28, the main body member 10 of the base is moved from the broken line position shown in FIG. 6 until rear wall 13 is spaced closely to member 28. During this movement, the base essentially pivots about its upper inner edge causing the horizontal edge of tongue 20 to bite into the inner surface of member 28 and securely lock these parts together and prevent vertical movement of the base relative to member 28. For this reason, tongue 20 is hardened steel. In order more securely to lock base 5 to member 28, T-nut 26 is positioned within member 28 so as to overlie the lips and screw 25 is tightened. The rearwardly bent tab 21 facilitates this connection by biting into the inner surface of channel member 28 as screw 25 is tightened. Access to screw 25 from the front of the base for locking and unlocking the latter is provided by recess 19 in the front wall.

Figure 7:
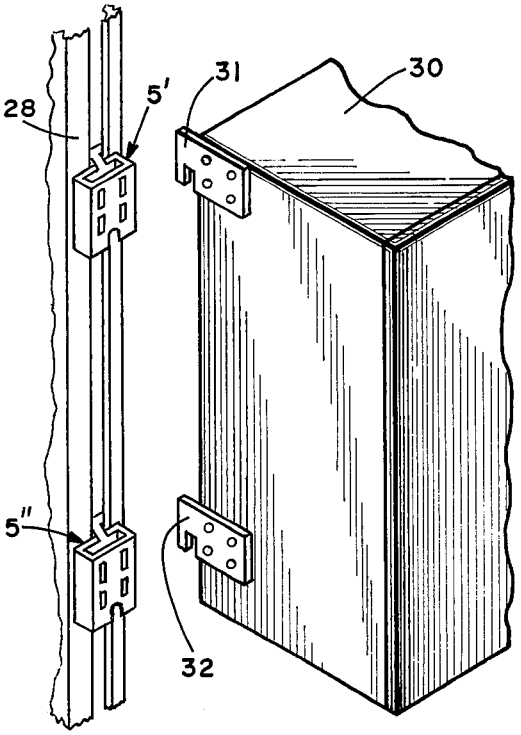
FIG. 7 is a perspective view of a pair of bases in operative position on a channel member to receive cabinet mounted brackets.

In a preferred embodiment of the invention two columns of slot pairs are provided as shown in the drawing although more than two columns may be used if desired, provided the columns are symmetrical about the center plane. The lateral spacing of these slot columns is sufficient to permit two brackets to engage and be supported in adjacent columns. In addition, the rectangular tubular shape and open ends of the base permit it to be used as a support for a cabinet 30, part of which is shown in FIG. 7. For this purpose, two bases 5' and 5'' are vertically spaced on and locked to channel member 28 so as to receive the vertically spaced brackets 31 and 32 which fit into the open upper ends, respectively, of the bases. The other side of the cabinet is similarly supported in a pair of bases. This manner of cabinet support has the additional advantage of accommodating limited variations in cabinet width because of the long dimension of the base cross section.

Base 5 preferably is made from one-piece channel stock which comprises front wall 12 and side walls 14 and 15 to which rear wall 13 is welded. The slots, recesses, tongue and screw hole are preformed prior to welding. By way of example, the bracket base shown in the drawings which has been successfully used in the field has a width of 1½ inches, a height of 3 inches and a depth of ½ inch and is formed from 0.090 inch thick steel.

What is claimed is:

1. A bracket base for connecting a shelf bracket to a forwardly opening lipped channel member comprising a tubular member with at least one end open and having a rectangular cross section, said member having plane front and back walls and side walls, said front and back walls being wider than said side walls whereby the long dimension of the rectangular open end of the member is parallel to the front and back walls, said back wall having a central rearwardly inclined T-shaped tongue projecting therefrom at said one end and adapted to be inserted into the opening of said channel member, said front wall having a plurality of laterally spaced pairs of longitudinally elongated longitudinally spaced slots adapted to receive portions of a bracket to be supported, and means on the end of said back wall opposite said one end for locking said base to said channel member.

2. The base according to claim 1 in which said front wall has two of said pairs of slots spaced equally from the longitudinal central plane of said base, said front, back and side walls having edges at said one end lying in a common plane.

3. The base according to claim 1 in which said locking means comprises a screw and T-nut, said front wall having an opening therein aligned with said screw to provide access to said screw.

4. The base according to claim 3 in which the end of said back wall opposite said one end has an integral central tab inclined rearwardly from the plane of said back wall, said tab having a hole for receiving said screw.

* * * * *